US009465354B2

(12) United States Patent
Park et al.

(10) Patent No.: US 9,465,354 B2
(45) Date of Patent: Oct. 11, 2016

(54) IMAGING CARTRIDGE AND ELECTROPHOTOGRAPHIC IMAGE FORMING APPARATUS USING THE SAME

(71) Applicant: SAMSUNG ELECTRONICS CO., LTD., Suwon-si, Gyeonggi-do (KR)

(72) Inventors: Seung-chan Park, Hwaseong-si (KR); Dong-cheol Ahn, Suwon-si (KR); Sang-hoon Lee, Suwon-si (KR); Seong-ho Jeong, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/592,504

(22) Filed: Jan. 8, 2015

(65) Prior Publication Data

US 2015/0323897 A1 Nov. 12, 2015

(30) Foreign Application Priority Data

May 7, 2014 (KR) ..... 10-2014-0054439

(51) Int. Cl.
*G03G 21/18* (2006.01)

(52) U.S. Cl.
CPC ..... *G03G 21/1825* (2013.01); *G03G 21/1817* (2013.01)

(58) Field of Classification Search
CPC ..... G03G 21/1817; G03G 21/1821; G03G 21/1825; G03G 15/0834; G03G 15/0832; G03G 21/18; G03G 15/0808; G03G 15/1853; G03G 15/1857
See application file for complete search history.

(56) References Cited

U.S. PATENT DOCUMENTS

| | | | | |
|---|---|---|---|---|
| 7,844,197 | B2 | 11/2010 | Ishii et al. | |
| 2003/0113131 | A1* | 6/2003 | Watanabe et al. | 399/111 |
| 2004/0184835 | A1* | 9/2004 | Park | 399/116 |
| 2006/0039717 | A1* | 2/2006 | Hatori | 399/111 |
| 2006/0045603 | A1* | 3/2006 | Hatori et al. | 400/693 |
| 2006/0262148 | A1* | 11/2006 | Kweon | 347/1 |

(Continued)

FOREIGN PATENT DOCUMENTS

| | | |
|---|---|---|
| JP | 2006-184502 | 7/2006 |
| JP | 2012-247717 | 12/2012 |
| KR | 10-2013-00566682 | 5/2013 |

OTHER PUBLICATIONS

Korean Office Action issued Jul. 23, 2015 in Korean Patent Application No. 10-2014-0054439.

(Continued)

*Primary Examiner* — Clayton E Laballe
*Assistant Examiner* — Ruifeng Pu
(74) *Attorney, Agent, or Firm* — Staas & Halsey LLP

(57) ABSTRACT

An imaging cartridge includes a photoconductive unit including a photoconductor on which an elastic latent image is formed; a development unit including a development roller that supplies toner to the photoconductor to develop the toner and a gap maintaining member that constrains an approach distance of the development roller with respect to the photoconductor; a first position determining portion provided in the development unit; a lateral bracket that is fixed to a side portion of the photoconductive unit and has a second position determining portion that guides the first position determining portion so as to movably support the development unit; and an elastic member that applies to the development unit an elastic force in a direction in which the development roller approaches the photoconductive unit.

22 Claims, 10 Drawing Sheets

(56) References Cited

U.S. PATENT DOCUMENTS

| | | | | |
|---|---|---|---|---|
| 2008/0159772 | A1* | 7/2008 | Koishi et al. | 399/90 |
| 2008/0181659 | A1* | 7/2008 | Noh | 399/114 |
| 2009/0110434 | A1* | 4/2009 | Kusudo et al. | 399/109 |
| 2011/0052266 | A1* | 3/2011 | Yoon et al. | 399/258 |
| 2011/0236064 | A1* | 9/2011 | Fujii | 399/119 |
| 2012/0177400 | A1* | 7/2012 | Jang et al. | 399/111 |
| 2013/0051849 | A1* | 2/2013 | Itabashi et al. | 399/111 |
| 2013/0064568 | A1* | 3/2013 | Fujiwara et al. | 399/90 |
| 2013/0094882 | A1 | 4/2013 | Miyabe et al. | |
| 2013/0129384 | A1* | 5/2013 | Kim et al. | 399/111 |
| 2013/0164028 | A1* | 6/2013 | Morioka et al. | 399/111 |
| 2013/0164029 | A1* | 6/2013 | Fukui et al. | 399/111 |
| 2013/0209137 | A1 | 8/2013 | Hayashi et al, | |
| 2013/0251402 | A1* | 9/2013 | Yamashita et al. | 399/111 |
| 2014/0003841 | A1* | 1/2014 | Kobayashi et al. | 399/167 |
| 2014/0205314 | A1* | 7/2014 | Chang et al. | 399/110 |
| 2014/0205318 | A1* | 7/2014 | LEE et al. | 399/111 |
| 2015/0093146 | A1* | 4/2015 | Sato et al. | 399/111 |

OTHER PUBLICATIONS

Korean Notice of Allowance dated Mar. 24, 2016 in Korean Patent Application No. 10-2014-0054439.

* cited by examiner

IMAGING CARTRIDGE AND ELECTROPHOTOGRAPHIC IMAGE FORMING APPARATUS USING THE SAME

CROSS-REFERENCE TO RELATED APPLICATIONS

This application claims the priority benefit of Korean Patent Application No. 10-2014-0054439, filed on May 7, 2014, in the Korean Intellectual Property Office, the disclosure of which is incorporated herein in its entirety by reference.

BACKGROUND

1. Field

One or more embodiments relate to an image forming apparatus that forms an image on a recording medium and an imaging cartridge that is attached to or detached from the image forming apparatus.

2. Description of the Related Art

An electrophotographic image forming apparatus prints an image on a recording medium by supplying toner onto an electrostatic latent image formed on a photoreceptor to form a visible toner image on the photoreceptor, transferring the visible toner image onto the recording medium, and fusing the transferred visible toner image on the recording medium.

A process cartridge is an assembly of components for forming a visible toner image. The process cartridge is a consumable product that is detachable from a main body of an image forming apparatus and replaced after the lifespan thereof has ended. The process cartridge may have various structures such as a structure in which a photoreceptor, a development roller that supplies toner to the photoreceptor, and a container portion containing toner are integrally formed, a structure divided into an imaging cartridge including a photoreceptor and a development roller and a toner cartridge containing toner, or a structure divided into a photoreceptor cartridge including a photoreceptor, a development cartridge including a development roller, and a toner cartridge containing toner.

Regarding the process cartridge including the imaging cartridge and the toner cartridge, the imaging cartridge has a structure in which a photoconductive unit including a photoreceptor and a development unit including a development roller are connected to each other. In this case, in order to obtain a uniform image quality, a distance between the photoreceptor and the development roller has to be stably maintained.

SUMMARY

One or more embodiments include an imaging cartridge in which a distance between a photoreceptor and a development roller is stably maintained, and an image forming apparatus using the imaging cartridge.

Additional aspects will be set forth in part in the description which follows and, in part, will be apparent from the description, or may be learned by practice of the presented embodiments.

According to an aspect, an imaging cartridge that attached to or detached from a main body of an image forming apparatus, the imaging cartridge includes: a photoconductive unit including a photoconductor on which an elastic latent image is formed; a development unit including a development roller that supplies toner to the photoconductor to develop the toner and a gap maintaining member that constrains an approach distance of the development roller with respect to the photoconductor; a first position determining portion provided in the development unit; a lateral bracket that is fixed to a side portion of the photoconductive unit and includes a second position determining portion that guides the first position determining portion so as to movably support the development unit; and an elastic member that applies to the development unit an elastic force in a direction in which the development roller approaches the photoconductive unit.

The first position determining portion may include first and second position determining bosses, and the second position determining portion may include first and second position determining slots that have a length such that the development unit is moved in a direction in which the development roller approaches the photoconductor or is separated from the photoconductor. The first and second position determining slots may have a width such that the development unit is rotatable, and rotation of the development unit may be constrained as the first and second position determining bosses contact sidewalls of the first and second position determining slots in a width direction.

The imaging cartridge may further include a driving coupler that is provided at a side of the development unit and transfers a driving force of the main body to the development roller, wherein a rotational direction of the driving coupler is opposite a rotational direction of the development roller. A direction of a rotational moment applied to the development unit by the driving coupler may be the same as a direction of a rotational moment applied to the development unit by the elastic member.

The second position determining portion may include a rotation constraining unit that constrains rotation of the development unit.

The first position determining portion may include first and second position determining bosses, and the second position determining portion may include first and second position determining slots that have a length such that the development unit is moved in a direction in which the development roller approaches the photoconductor or is separated from the photoconductor, and the first position determining boss may be located at a rotational center of the development roller. The development roller may form a development nip by contacting the photoconductor.

The first position determining portion may include first and second position determining bosses, and the second position determining portion may include first and second position determining slots that have a length such that the development unit is moved in a direction in which the development roller approaches the photoconductor or is separated from the photoconductor, and the first and second position determining bosses may be disposed on the same side as the development roller with respect to an area where the development roller and the photoconductor face each other, and the driving coupler may be disposed between the first and second position determining bosses.

The imaging cartridge may further include a driving side portion where the driving coupler is disposed and a non-driving side portion on the opposite side the driving side portion, and the elastic member may include first and second elastic members that are respectively disposed on the driving side portion and the non-driving side portion, and an elastic force of the first elastic member may be smaller than an elastic force of the second elastic member.

According to an aspect, an imaging forming apparatus includes: a main body; and the imaging cartridge described above, wherein the imaging cartridge is attached to or detached from the main body.

The imaging forming apparatus may further include a toner cartridge that is attached to or detached from the main body and supplies toner to the imaging cartridge. The toner cartridge may include a toner outlet through which the toner is discharged and a discharging shutter that opens or closes the toner outlet, wherein the discharging shutter is moved to a position where the toner outlet is opened by interfering with the imaging cartridge when the toner cartridge is mounted in the main body.

The lateral bracket may include an interference portion that interferes with the discharging shutter to move the discharging shutter to a position where the toner outlet is opened when the toner cartridge is mounted in the main body.

The toner cartridge may further include a shutter spring that elastically biases the discharging shutter such that the discharging shutter is moved to a position where the toner outlet is closed.

The imaging cartridge may include a toner inlet through which the toner enters and an inlet shutter that opens or closes the toner inlet. The imaging cartridge may further include a spring that elastically biases the inlet shutter to a position where the toner inlet is closed. The inlet shutter may be moved in connection with an operation of mounting of the toner cartridge to the main body to a position where the toner inlet is opened. A protrusion may be provided on the toner cartridge to open the inlet shutter.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
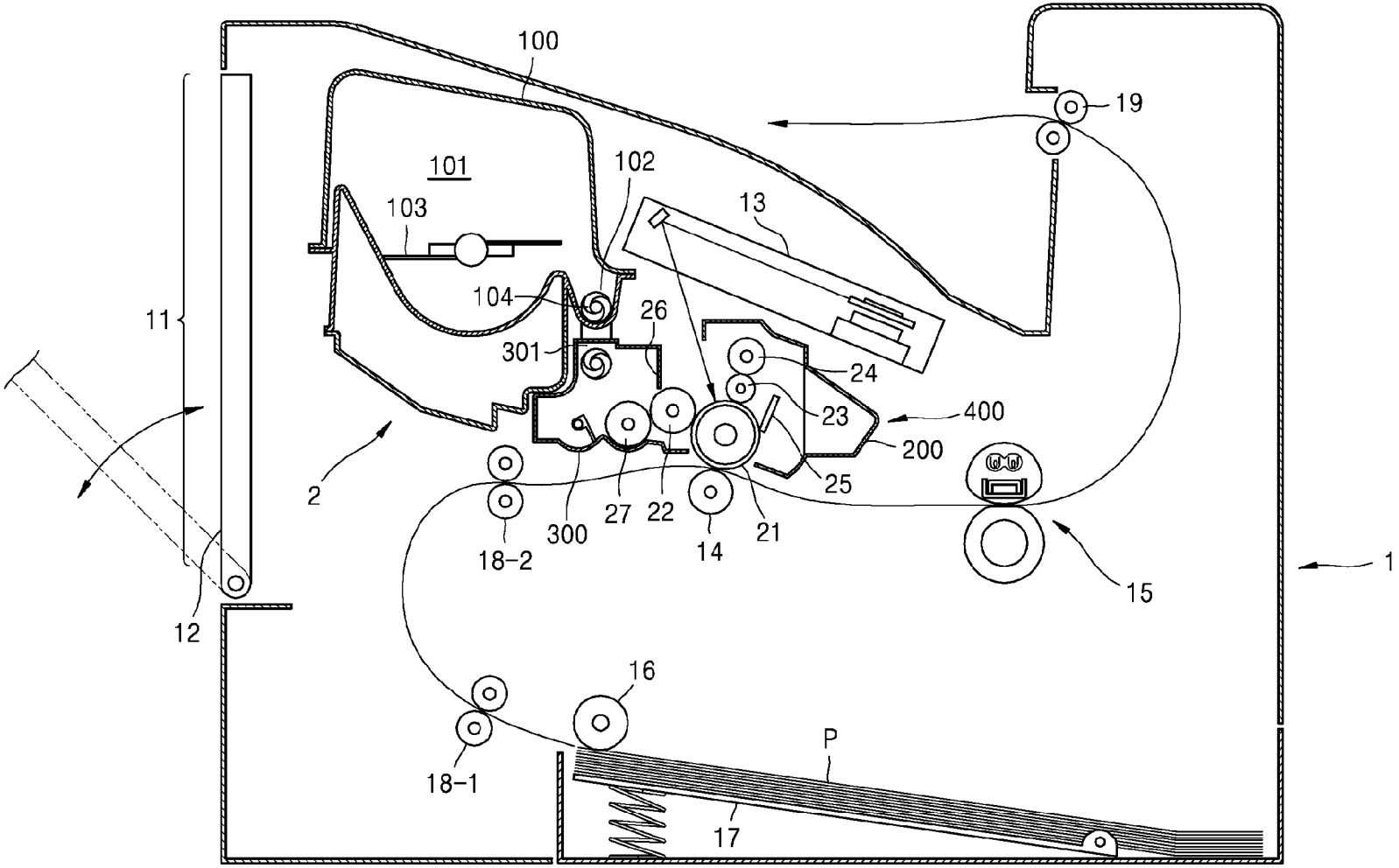
FIG. 1 is a schematic structural diagram of an electrophotographic image forming apparatus according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description.

FIG. 1 is a schematic structural diagram of an electrophotographic image forming apparatus according to an embodiment.

Referring to FIG. 1, a main body 1 of the image forming apparatus and a process cartridge 2 are shown. The main body 1 includes an opening 11 providing a passage for the process cartridge 2 to be mounted in or removed from the main body 1. A cover 12 closes or opens the opening 11. The main body 1 includes an exposure unit 13, a transfer roller 14, and a fusing unit 15. Also, the main body 1 includes a recording medium transfer structure for loading and transferring a recording medium P where an image is to be formed.

The process cartridge 2 may include a toner containing unit 101, a photoconductive drum 21, on a surface of which an electrostatic latent image is formed, and a development roller 22 that receives toner from the toner containing unit 101 to supply the toner to the electrostatic latent image so as to develop the electrostatic latent image into a visible toner image.

The process cartridge 2 may have a first structure divided into an imaging cartridge 400 including the photoconductive drum 21 and the development roller 22 and a toner cartridge 100 including the toner containing unit 101, a second structure divided into a photoreceptor cartridge 200 including the photoconductive drum 21, a development cartridge 300 including the development roller 22, and a toner cartridge 100 including the toner containing unit 101, a third structure divided into a photoreceptor cartridge 200 and a development cartridge 300 including the toner containing unit 101, or a fourth structure in which a photoreceptor cartridge 200, a development cartridge 300, and a toner cartridge 100 are integrally formed with one another.

In the process cartridge 2 having the first structure (or the second structure), when the toner cartridge 100 is mounted in the main body 1, the toner cartridge 100 is connected to the imaging cartridge 400 (or the development cartridge 300). For example, when the toner cartridge 100 is mounted in the main body 1, a toner discharging unit 102 of the toner cartridge 100 and a toner inlet portion 301 of the imaging cartridge 400 (or the development cartridge 300) are connected to each other. A first toner supply member 103 that supplies toner to the toner discharging unit 102 is disposed in the toner containing unit 101. A second toner supply member 104 that transports the toner in a length direction of the toner discharging unit 102 is disposed in the toner discharging unit 102. The first toner supply member 103 radially transports the toner to supply the same to the toner discharging unit 102. For example, a rotating paddle may be used as the first toner supply member 103. The second toner supply member 104 transports the toner supplied by using the first toner supply member 104 in an axial direction of the second toner supply member 104. For example, an auger may be used as the second toner supply member 104.

Figure 2:
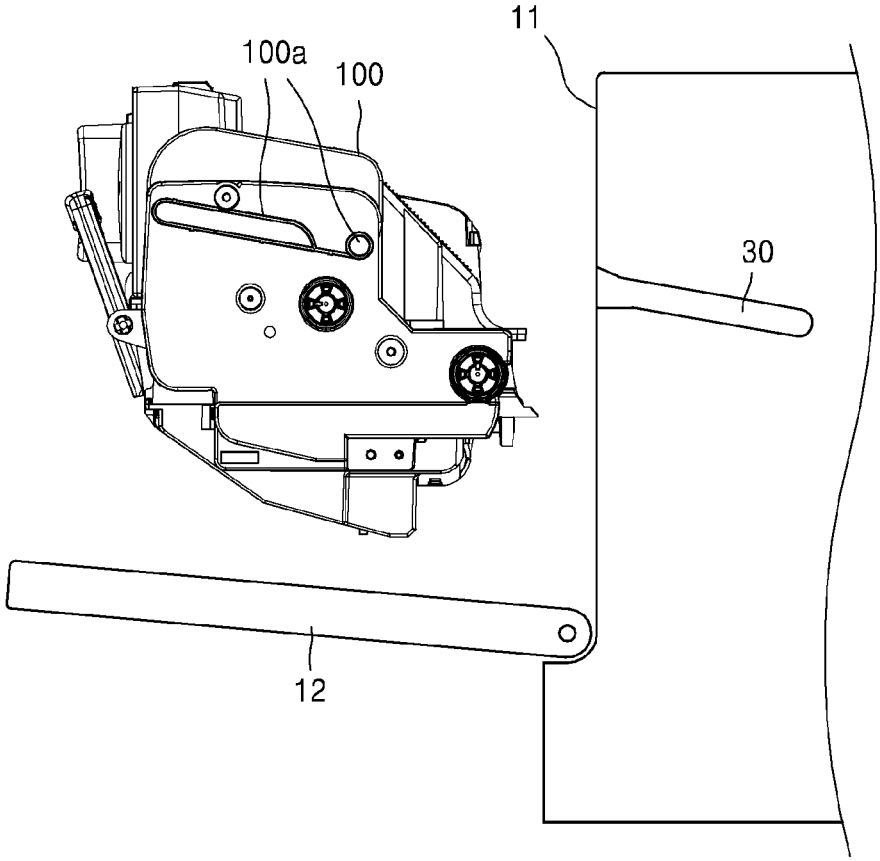
FIG. 2 illustrates replacement of a toner cartridge.

The process cartridge 2 according to an embodiment has the first structure. Thus, the imaging cartridge 400 and the toner cartridge 100 may be individually attached to or detached from the main body 1. The process cartridge 2 is a consumable product that is replaced after its lifespan expires. The lifespan of the imaging cartridge 400 is longer than the lifespan of the toner cartridge 100. When toner contained in the toner containing unit 101 is consumed completely, just the toner cartridge 100 may be replaced so as to reduce costs for replacement of consumables. Referring to FIG. 2, for example, a guide protrusion 100*a* may be formed on a side portion of the toner cartridge 100, and a guide rail 30 that guides the guide protrusion 100*a* may be provided in the main body 1. The toner cartridge 100 may be guided by using the guide rail 30 to be attached to or detached from the main body 1. Although not illustrated in the drawing, a guide unit that guides the imaging cartridge 400 is provided in the main body 1.

The photoreceptor cartridge 200 includes the photoconductive drum 21. The photoconductive drum 21 is an example of a photoreceptor, an electrostatic latent image being formed on a surface thereof, and may include a conductive metal pipe and a photosensitive layer around the conductive metal pipe. A charging roller 23 is an example of a charger for charging the photoconductive drum 21 to have a uniform surface potential. A charging brush or a corona charger may be used instead of the charging roller 23. A cleaning roller 24 is used to remove foreign materials on a surface of the charging roller 23. A cleaning blade 25 is an example of a cleaning unit for removing toner and foreign materials on a surface of the photoconductive drum 21 after a transfer process which will be described later. A cleaning unit having another shape, such as a rotating brush, may be used instead of the cleaning blade 25. However, the cleaning blade 25 or the rotating brush are examples of a cleaning unit, but any type of cleaning unit can be used to clean photoconductive drum 21.

The development cartridge 300 receives toner from the toner cartridge 100 to supply the toner to the electrostatic latent image so as to develop the electrostatic latent image into a visible toner image.

Examples of a development method include a one-component development method in which toner is used and a two-component development method in which toner and a carrier are used. The imaging cartridge 400 according to an embodiment uses a one-component development method.

Figure 3A:
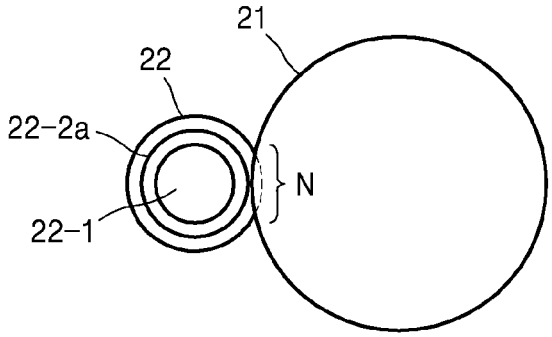
FIG. 3A is a diagram of an arrangement of a photoconductive drum and a development roller according to a contact development method.
Figure 3B:
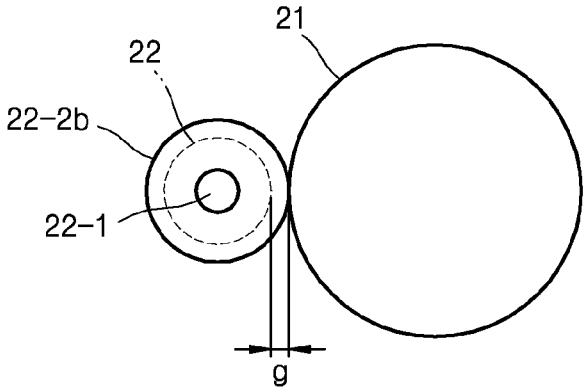
FIG. 3B is a diagram of an arrangement of a photoconductive drum and a development roller according to a non-contact development method.

The development roller 22 is used to supply toner to the photosensitive drum 21. A development bias voltage to supply toner to the photosensitive drum 21 may be applied to the development roller 22. The one-component development method may be classified into a contact development method, wherein the development roller 22 and the photoconductive drum 21 are rotated while contacting each other, and a non-contact development method, wherein the development roller 22 and the photoconductive drum 21 are rotated by being spaced apart from each other by dozens to hundreds of microns. FIG. 3A is a diagram of an arrangement of the photoconductive drum 21 and the development roller 22 in the contact development method, and FIG. 3B is a diagram of an arrangement of the photoconductive drum 21 and the development roller 22 in the non-contact development method. Referring to FIG. 3A, in the contact development method, a gap maintaining member 22-2*a* having a smaller diameter than the development roller 22 may be provided on each of both ends of a rotation shaft 22-1 of the development roller 22. The photoconductive drum 21 is constrained by the gap maintaining member 22-2*a* which contacts the surface of the photoconductive drum 21. A development nip N is formed as the development roller 22 contacts the photoconductive drum 21. Referring to FIG. 3B, in the non-contact development method, a gap maintaining member 22-2*b* having a larger diameter than the development roller 22 may be provided on each of the both ends of the rotation shaft 22-1 of the development roller 22. A development gap g between the development roller 22 and the photoconductive drum 21 is formed in a development region where the development roller 22 and the photoconductive drum 21 face each other as the gap maintaining member 22-2*b* contacts the surface of the photoconductive drum 21.

The gap maintaining members 22-2*a* and 22-2*b* maintains a constant distance between the development roller 22 and the photoconductive drum 21 so that the development nip N or the development gap g is maintained constant too. The gap maintaining members 22-2*a* and 22-2*b* do not necessarily contact a surface of the photoconductive drum 21. Also, the gap maintaining members 22-2*a* and 22-2*b* do not have to be necessarily mounted on the rotation shaft 22-1 of the development roller 22.

A regulator 26 constrains an amount of toner supplied by the development roller 22 to a development region where the photoconductive drum 21 and the development roller 22 face each other. The regulator 26 may be a doctor blade elastically contacting a surface of the development roller 22. A supply roller 27 supplies toner in the process cartridge 2 to a surface of the development roller 22. To this end, a supply bias voltage may be applied to the supply roller 27.

When a two-component development method is used, the development roller 22 is spaced apart from the photoconductive drum 21 by dozens to hundreds of microns. Although not illustrated in the drawings, the development roller 22 may have a structure in which a magnetic roller is disposed in a hollow cylindrical sleeve. The toner is adhered to a surface of a magnetic carrier. The magnetic carrier is adhered to the surface of the development roller 22 to be transferred to the development region where the photoconductive drum 21 and the development roller 22 face each other. Only the toner is supplied to the photoconductive drum 21 according to the development bias voltage applied between the development roller 22 and the photoconductive drum 21, and thus the electrostatic latent image formed on the surface of the photoconductive drum 21 is developed into the visible toner image. The process cartridge 2 may include an agitator (not shown) for mixing and stirring the toner and a carrier and transporting the mixture to the development roller 22. The agitator may be, for example, an auger or a plurality of the agitators.

The exposure unit 13 forms the electrostatic latent image on the photoconductive drum 21 by irradiating light modulated according to image information to the photoconductive drum 21. The exposure unit 13 may be a laser scanning unit (LSU) using a laser diode as a light source, or a light-emitting diode (LED) exposure unit using an LED as a light source.

The transfer roller 14 is an example of a transfer unit for transferring a toner image from the photoconductive drum 21 to the recording medium P. A transfer bias voltage for transferring the toner image to the recording medium P is applied to the transfer roller 14. A corona transfer unit or a transfer unit using a pin scorotron method may be used instead of the transfer roller 14.

The recording media P are picked up one by one from a loading table 17 by a pickup roller 16, and are transferred by feed rollers 18-1 and 18-2 to a region where the photoconductive drum 21 and the transfer roller 14 face each other.

The fusing unit 15 applies heat and pressure to an image transferred to the recording medium P so as to fuse the image on the recording medium P. The recording medium P that passed through the fusing unit 15 is discharged outside the main body 1 by a discharge roller 19.

According to the above structure, the exposure unit 13 irradiates the light modulated according to the image information to the photoconductive drum 21 to develop the electrostatic latent image. The development roller 22 supplies the toner to the electrostatic latent image to form the visible toner image on the surface of the photoconductive drum 21. The recording medium P loaded in the loading table 17 is transferred to the region where the photoconductive drum 21 and the transfer roller 14 face each other by the pickup roller 16 and the feed rollers 18-1 and 18-2, and the toner image is transferred on the recording medium P from the photoconductive drum 21 according to the transfer bias voltage applied to the transfer roller 14. After the recording medium P passes through the fusing unit 15, the toner image is fused on the recording medium P according to heat and pressure. After the fusing, the recording medium P is discharged by the discharge roller 19.

Hereinafter, the photoreceptor cartridge 200 and the development cartridge 300 which constitute the imaging cartridge 400 will be referred to as a photoconductive unit 200 and a development unit 300, respectively. The photoconductive unit 200 and the development unit 300 are connected to each other such that the development nip N or the development gap g may be maintained constant. To this end, the photoconductive unit 200 and the development unit 300 may be fixedly connected by using a pair of lateral brackets (not shown). According to a connection method described above (a fixed axis method), a distance between the photoconductive drum 21 and the development roller 22 is fixed. While the fixed axis method has a simple structure, an accuracy regarding the development nip N or the development gap g is determined based on tolerances of components of the photoconductive unit 200 or the development unit 300, and thus, components having a high dimensional precision are required. Moreover, if the components are worn away after use for long time, the distance between the photoconductive drum 21 and the development roller 22 changes, and accordingly, the development nip N or the development gap g are also changed. This may decrease the uniformity of an image quality.

Regarding the imaging cartridge 400 according to an embodiment, the photoconductive unit 200 and the development unit 300 are connected with each other by using a variable axis method in which the development unit 300 is movable with respect to the photoconductive unit 200. According to this structure, when components are worn away due to long time use, even if a distance between the photoconductive drum 21 and the development roller 22 varies, the development unit 300 is movable with respect to the photoconductive unit 200 to maintain the development nip N or the development g, and thus, the uniformity of an image quality may be improved.

Figure 4:
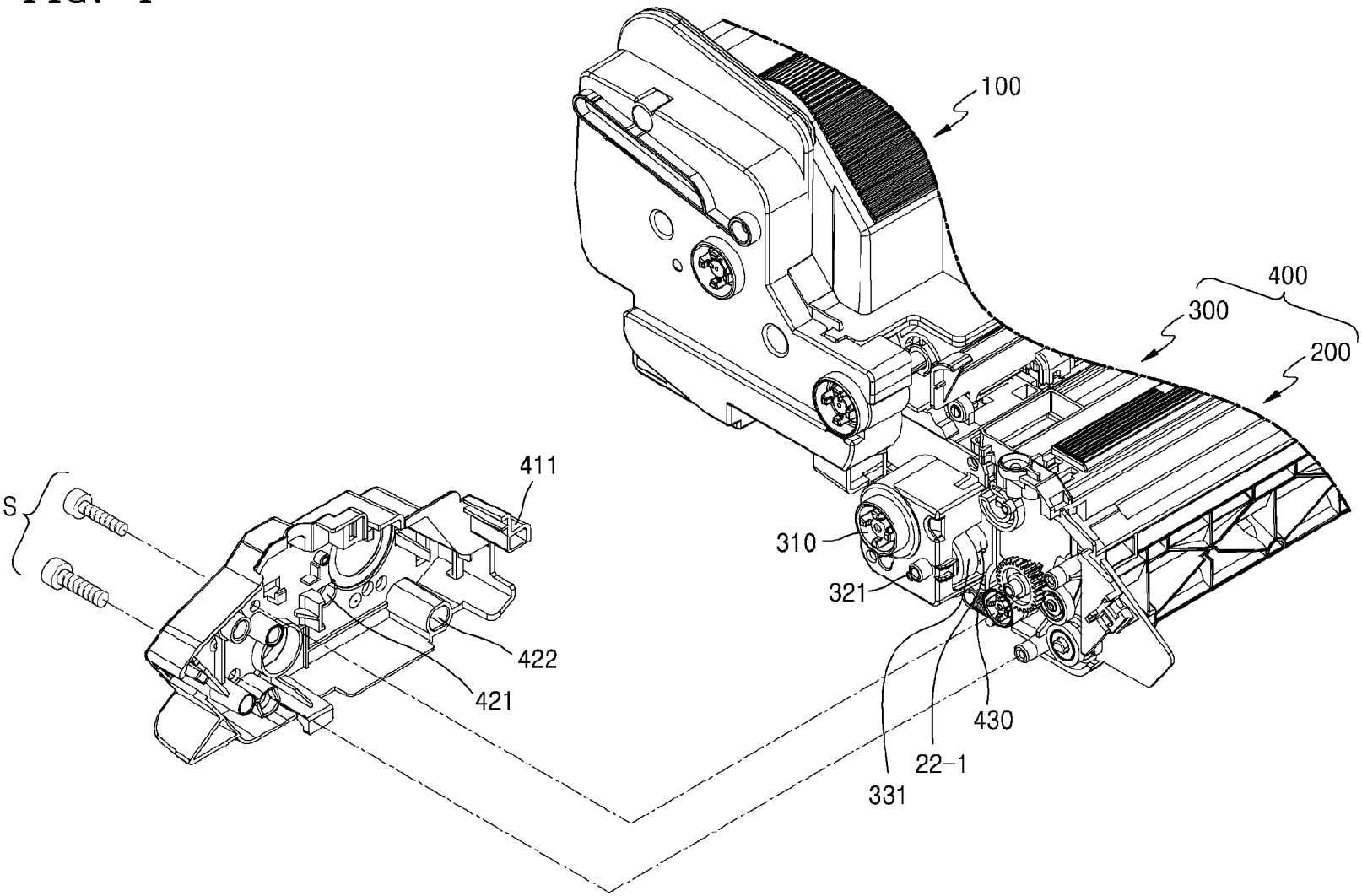
FIG. 4 is a disassembled perspective view of an imaging cartridge from which a lateral bracket is separated, according to an embodiment.
Figure 5:
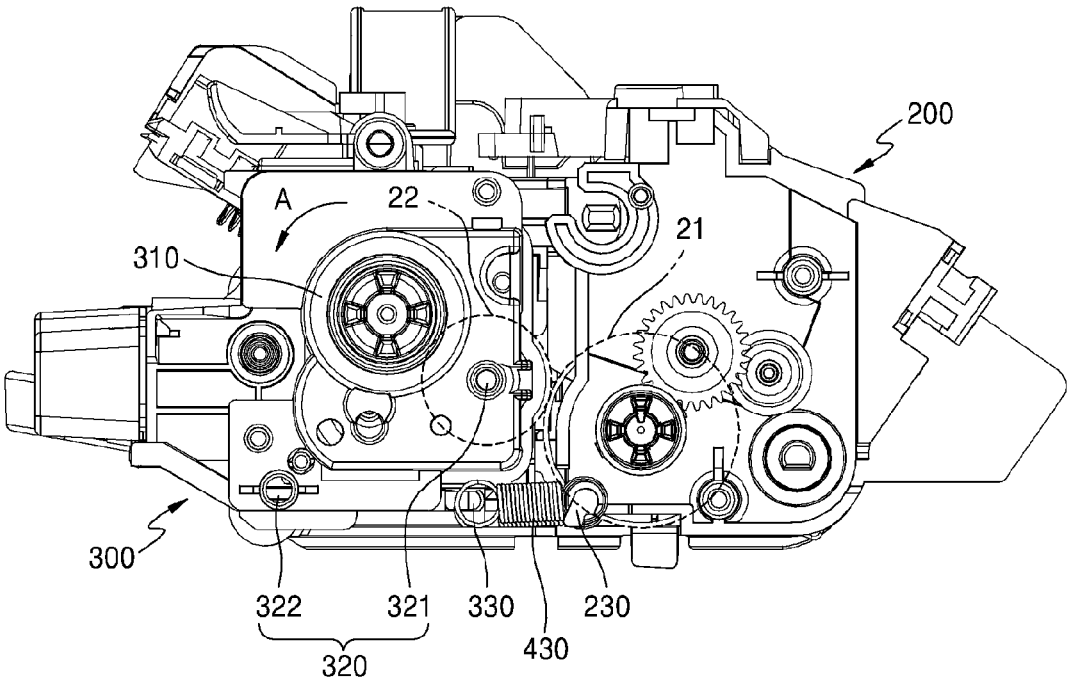
FIG. 5 is a schematic side view of the imaging cartridge from which a lateral bracket is separated, according to an embodiment.
Figure 6:
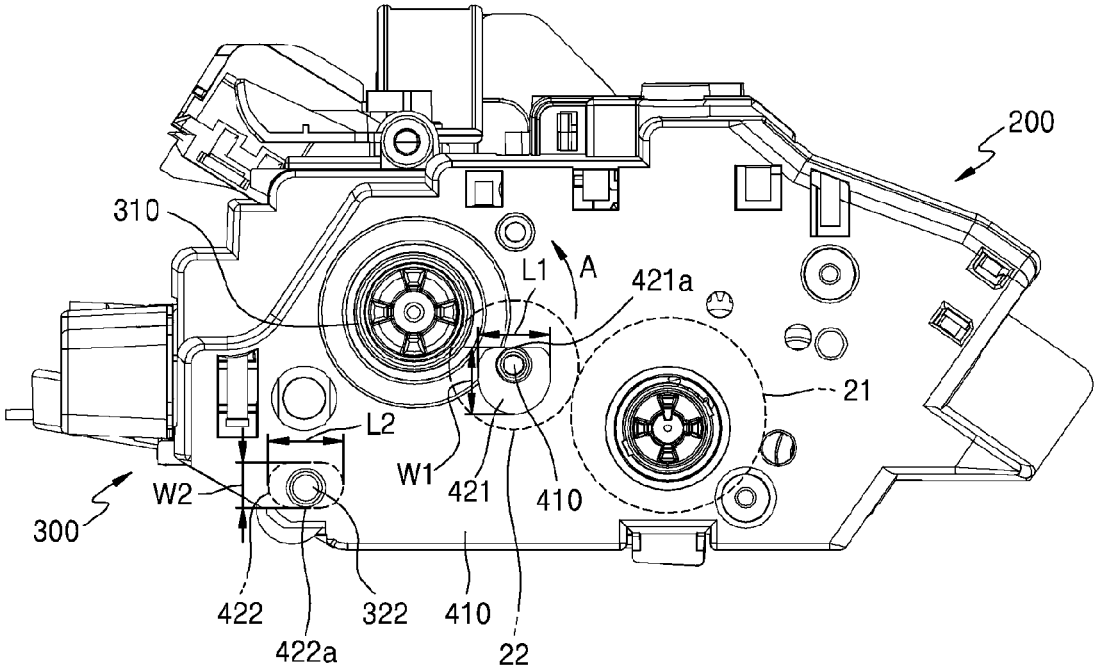
FIG. 6 is a side view of the imaging cartridge to which the lateral bracket is mounted.

Hereinafter, a connection unit that connects the photoconductive unit 200 and the development unit 300 when a variable axis method is used will be described according to an embodiment. FIG. 4 is a disassembled perspective view of the imaging cartridge 400 from which a lateral bracket 410 is separated. FIG. 5 is a schematic side view of the imaging cartridge 400 from which the lateral bracket 410 is separated. FIG. 6 is a side view of the imaging cartridge 400 to which the lateral bracket 410 is mounted.

Referring to FIGS. 4, 5, and 6, the lateral bracket 410 is coupled to a side portion of the photoconductive unit 200, that is, a side portion in a length direction of the photoconductive drum 21. The lateral bracket 410 may be coupled to the side portion of the photoconductive unit 200 by using, for example, a screw S.

A driving coupler 310 is provided in the development unit 300. The driving coupler 310 is connected to a driving unit (not shown) provided in a main body 1 when the imaging cartridge 400 is mounted in the main body 1. As the driving coupler 310 is connected to the development roller 22, a driving force supplied from the main body 1 is transferred to the development roller 22. For example, the driving coupler 310 includes a gear portion (not shown) that is engaged with a gear 331 mounted on the rotation shaft 22-1 of the development roller 22. A rotational direction of the driving coupler 310 is opposite to a rotational direction of the development roller 22.

A position determining unit that determines a position of the development roller 22 with respect to the photoconductive drum 21 is provided in the imaging cartridge 400. A plurality of first position determining portions 321 and 322 are provided in the development unit 300. Second position determining portions 421 and 422 corresponding to the first position determining portions 321 and 322 are provided in the lateral bracket 410. The second position determining portions 421 and 422 may respectively have a complementary shape with respect to the first position determining portions 321 and 322. The second position determining portions 421 and 422 guide the first position determining portions 321 and 322 such that the development unit 300 may be moved in a direction in which the development roller 22 approaches the photoconductive drum 21 or is separated from the photoconductive drum 21. For example, the first position determining portions 321 and 322 may have a boss shape protruding from the side portion of the development unit 300. Hereinafter, the first position determining portions 321 and 322 will be referred to as first and second position determining bosses 321 and 322. The first and second position determining bosses 321 and 322 may be, for example, cylindrical. The second position determining portions 421 and 422 may have a slot shape that guides the first and second position determining bosses 321 and 322. Hereinafter, the second position determining portions 421 and 422 will be referred to as first and second position determining slots 421 and 422.

An elastic member 430 applies to the development unit 300 an elastic force in a direction in which the development roller 22 approaches the photoconductive drum 21. The elastic member 430 may be, for example, a tensile coil spring. Spring hook portions 330 and 230 respectively supporting first and second ends of the elastic member 430 may be respectively provided in the development unit 300 and the photoconductive unit 200. The shape of the elastic member 430 is not limited to the tensile coil spring. The elastic member 430 may have various forms as long as an elastic force exerted in a direction in which the development roller 22 approaches the photoconductive drum 21 is applied to the development unit 300. For example, the elastic member 430 may be a leaf spring, or according to an arrangement position thereof, a compressed coil spring.

The lateral bracket 410 including the first and second position determining slots 421 and 422, the first and second position determining bosses 321 and 322, and the elastic member 430 are provided on two sides of the imaging cartridge 400 in a length direction of the photoconductive drum 21.

When the imaging cartridge 400 is mounted in the main body 1 and the driving coupler 310 is connected to a driving unit (not shown) provided in the main body 1, the driving coupler 310 is rotated in an arrow direction A of FIG. 5. Due to rotation of the driving coupler 310, a moment in the arrow direction A is exerted on the development unit 300. The first and second position determining slots 421 and 422 respectively have lengths L1 and L2 and widths W1 and W2. The lengths L1 and L2 and the widths W1 and W2 of the first and second position determining slots 421 and 422 are determined such that the development unit 300 may be moved in a direction in which the development roller 22 approaches the photoconductive drum 21 or is separated from the photoconductive drum 21. The widths W1 and W2 of the first and second position determining slots 421 and 422 are greater than diameters of the first and second position determining bosses 321 and 322. Rotation of the development unit 300 in the arrow direction A is constrained as the first and second position determining bosses 321 and 322 respectively contact side walls 421*a* and 422*a*. Accordingly, a rotation constraining unit that constrains rotation of the development unit 300 in the arrow direction A may be formed of the side walls 421*a* and 422*a* of the first and second position determining slots 421 and 422. Hereinafter, the side walls 421*a* and 422*a* will be referred to as rotation constraining units 421*a* and 422*a*.

Relative positions of the first and second position determining slots 421 and 422 of the lateral bracket 410 disposed at one side portion of the imaging cartridge 400 may be the same as positions of position determining slots (not shown) of another lateral bracket (not shown) disposed at the other side portion thereof. However, an error may occur in the relative positions of the first and second position determining slots 421 and 422 during the manufacture of the lateral bracket 410. When the widths W1 and W2 of the first and second position determining slots 421 and 422 are the same as the diameters of the first and second position determining bosses 321 and 322, and if there is an error in the relative positions, the development roller 22 and the photoconductive drum 21 may not be parallel and an image defect such as an image omission may be generated. As the widths W1 and W2 of the first and second position determining slots 421 and 422 are greater than the diameters of the first and second position determining bosses 321 and 322, a margin where the error in the relative positions of the first and position determining slots 421 and 422 of the lateral bracket 410 disposed at one side portion of the imaging cartridge 400 and the positions of position determining slots (not shown) of the lateral bracket (not shown) at the other side portion thereof may be secured, and an image defect such as an image omission due to distortion of the development roller 22 and the photoconductive drum 21 may be prevented.

Figure 7:
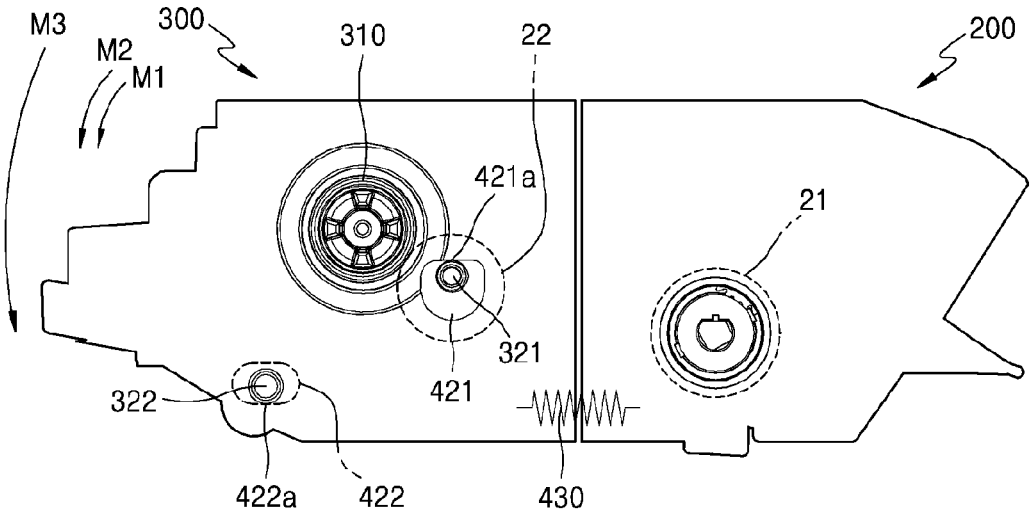
FIG. 7 is a lateral view illustrating a photoconductive unit and a development unit that are connected in a variable axis manner.
Figure 8:
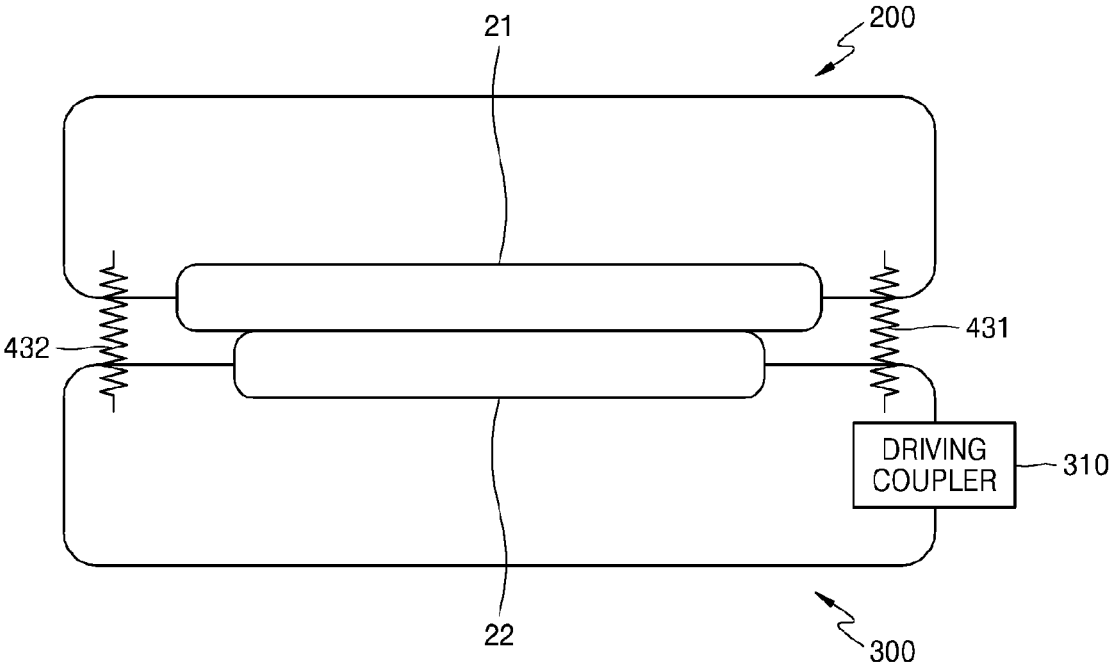
FIG. 8 is a plan view illustrating a photoconductive unit and a development unit that are connected in a variable axis manner.

FIGS. 7 and 8 are schematic views illustrating the photoconductive unit 200 and the development unit 300 that are connected in a variable axis manner. FIG. 7 is a side view and FIG. 8 is a plan view.

Referring to FIG. 7, due to an elastic force of the elastic member 430, the development unit 300 approaches the photoconductive drum 21, and the approaching movement of the development unit 300 toward the photoconductive drum 21 is allowed as the first and second position determining bosses 321 and 322 are guided to the first and second position determining slots 421 and 422. The approaching movement of the development unit 300 toward the photoconductive drum 21 is constrained by the gap maintaining members 22-2*a* and 22-2*b* described above with reference to FIGS. 3A and 3B. According to this structure, the development nip N or the development gap g may be stably maintained.

A rotational moment M3 is exerted on the development unit 300 in a direction in which the development nip N or the development gap g is maintained constant. The rotational moment M3 may include a rotational moment M1 due to the driving coupler 310 and a rotational moment M2 due to the elastic member 430. When the rotational moment M2 due to the elastic member 430 and the rotational moment M1 due to the driving coupler 310 are in opposite directions, the rotational moment M2 is offset by the rotational moment M1, thereby reducing the rotational moment M3 which maintains the development nip N or the development gap g constant. In other words, the elastic force of the elastic member 430 that maintains constant the development nip N or the development gap g is reduced by the rotational moment M1. By setting the rotational moment M1 and the rotational moment M2 to operate in the same direction, a sum of the rotational moment M3 that maintains constant the development nip N or the development gap g may be increased, and a decrease in the elastic force of the elastic member 430 due to the rotational moment M1 may be prevented. Accordingly, the development nip N or the development gap g may be more stably and easily maintained constant. An excessive rotation of the development unit 300 by the rotational moment M3 is constrained by the rotation constraining units 421*a* and 422*a* (sidewalls 421*a* and 422*a*) provided on the first and second position determining slots 421 and 422.

When one of the first and second position determining bosses 321 and 322 is disposed on the opposite side of the development roller 22 with respect to the development nip N or the development gap g, that is, at the photoconductive drum 21, the rotational moment M2 due to the elastic force of the elastic member 430 is exerted such that the development roller 22 is separated from the photoconductive drum 21, and accordingly, the development nip N or the development gap g may be unstable. According to an embodiment, the first and second position determining bosses 321 and 322 are disposed on the same side as the development roller 22 with respect to the development nip N or the development gap g. Accordingly, the development nip N or the development g may be stably maintained constant.

The driving coupler 310 is disposed on the same side as the development roller 22 with respect to the development nip N or the development gap g. The driving coupler 310 is disposed between the first and second position determining bosses 321 and 322. A rotational direction of the driving coupler 310 is opposite a rotational direction of the development roller 22.

According to an embodiment, a contact development method, in which the development roller 22 and the photoconductive drum 21 rotate while contacting each other, is used. In the contact type development method, a repulsive force that is proportional to a size of the development nip N is applied to the development roller 22, and a direction of rotational moment applied to the development unit 300 due to the repulsive force is a direction in which the development roller 22 and the photoconductive drum 21 are separated from each other. In order to keep the rotational moment due to the repulsive force as small as possible, one of the first and second position determining bosses 321 and 322 may be coaxially disposed with respect to the rotation shaft 22-1 of the development roller 22 (see FIGS. 3A and 3B). That is, the first position determining boss 321 is disposed at a rotational center of the development roller 22. According to this structure, the elastic force of the elastic member 430 may be used as much as possible in maintaining the development nip N constant, and thus, the development nip N may be stably maintained constant. Also, by disposing the first position determining boss 321 at the rotational center of the development roller 22, the number of positions for position management for maintaining the development nip N may be reduced.

Referring to FIG. 8, the elastic member 430 may include first and second elastic members 431 and 432 respectively disposed on sides of the development unit 300 and the photoconductive unit 200 and apply to the development unit 300 an elastic force in a direction in which the development roller 22 approaches the photoconductive drum 21.

The driving coupler 310 is disposed at a side portion of the development unit 300. The side portion of the imaging cartridge 400 where the driving coupler 310 is disposed is referred to as a driving side portion, and an opposite side portion of the imaging cartridge 400 is referred to as a non-driving side portion. The first and second elastic members 431 and 432 are respectively disposed at the driving side portion and the non-driving side portion.

As the elastic forces of the first and second elastic members 431 and 432 are equal, almost the same nip pressure is applied to the entire development nip N when the imaging cartridge 400 is not driven. The nip pressure is formed by the elastic forces of the first and second elastic members 431 and 432. When the imaging cartridge 400 is driven, a rotational moment due to the driving coupler 310 is exerted, and thus, the nip pressure of the development nip N is greater in an area where the driving coupler 310 is disposed than in an area where the driving coupler 310 is not. A deviation in the nip pressure in a length direction of the development nip N may cause a deviation in image quality in a length direction. Also, non-uniformity in the nip pressure in the length direction may cause a deviation in an amount of abrasion of the development roller 22 and the photoconductive drum 21 in the length direction. That is, the development roller 22 and the photoconductive drum 21 are worn away more at the side with a relatively high nip pressure, which results in a decrease in the lifetime of the imaging cartridge 400.

According to an embodiment, the elastic force of the first elastic member 431 disposed at the side where the driving coupler 310 is installed is smaller than the elastic force of the second elastic member 432 disposed at the opposite side. Accordingly, the nip pressure may be uniform over the entire development nip N. A difference in the elastic forces of the first elastic member 431 and the second elastic member 432 may be determined in consideration of a size of the rotational moment applied to the development unit 300 by using the driving coupler 310.

Figure 9:
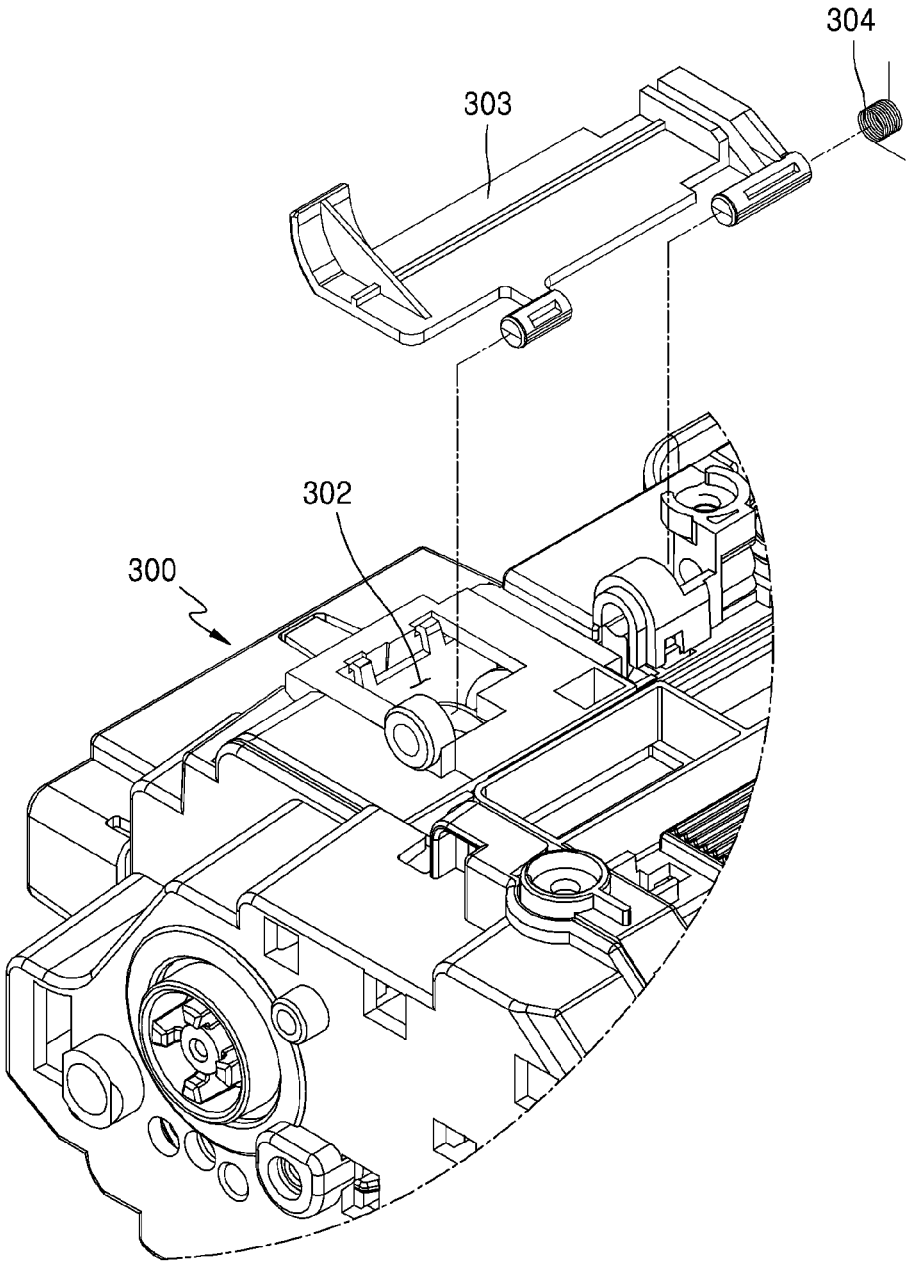
FIG. 9 is a schematic side perspective view of the imaging cartridge.

FIG. 9 is a schematic side perspective view of the imaging cartridge 400. Referring to FIG. 9, in order to prevent leakage of toner during handling of the imaging cartridge 400 or when attaching or detaching the imaging cartridge 400 to or from the main body 1, the toner inlet portion 301 (see FIG. 1) of the development unit 300 includes an inlet shutter that opens or closes the toner inlet 302. The inlet shutter 303 may be pivoted to a position where the toner inlet 302 is closed or to a position where the toner inlet 302 is opened. The inlet shutter 303 may be elastically biased via a spring 304 so as to be pivoted in a direction in which the toner inlet 302 is closed. The inlet shutter 303 may be moved to an opening position in connection with an operation of mounting the toner cartridge 100 to the main body 1.

Figure 10:
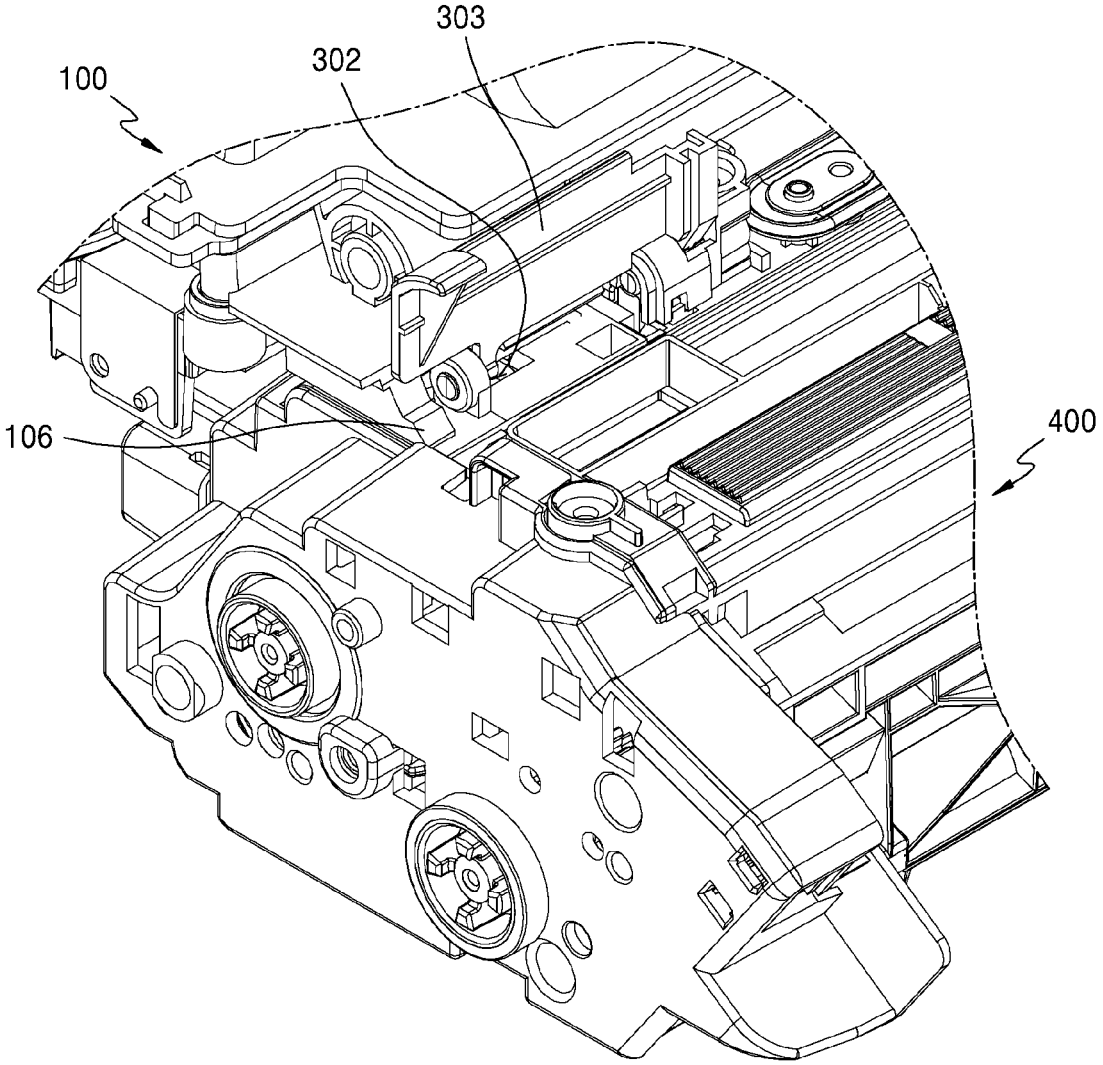
FIG. 10 is a side perspective view of the imaging cartridge when an inlet shutter is located at an open position via a toner cartridge.

FIG. 10 is a side view illustrating the imaging cartridge 400 when the inlet shutter 303 is located at the opening position via the toner cartridge 100. Referring to FIG. 10, a protrusion 106 via which the inlet shutter 303 is pivoted may be provided in the toner cartridge 100. When the toner cartridge 100 is started to be mounted in the main body 1, the protrusion 106 contacts the inlet shutter 303, and as the toner cartridge 100 is inserted into the main body 1, the inlet shutter 303 is pushed by the protrusion 106 to be pivoted. When mounting of the toner cartridge 100 is completed, the inlet shutter 303 is located at the position where the toner inlet 302 is opened, as illustrated in FIG. 10. When the toner cartridge 100 is detached from the main body 1, the inlet shutter 303 is returned to the position where the toner inlet 302 is closed by the elastic force of the spring 304.

Figure 11:
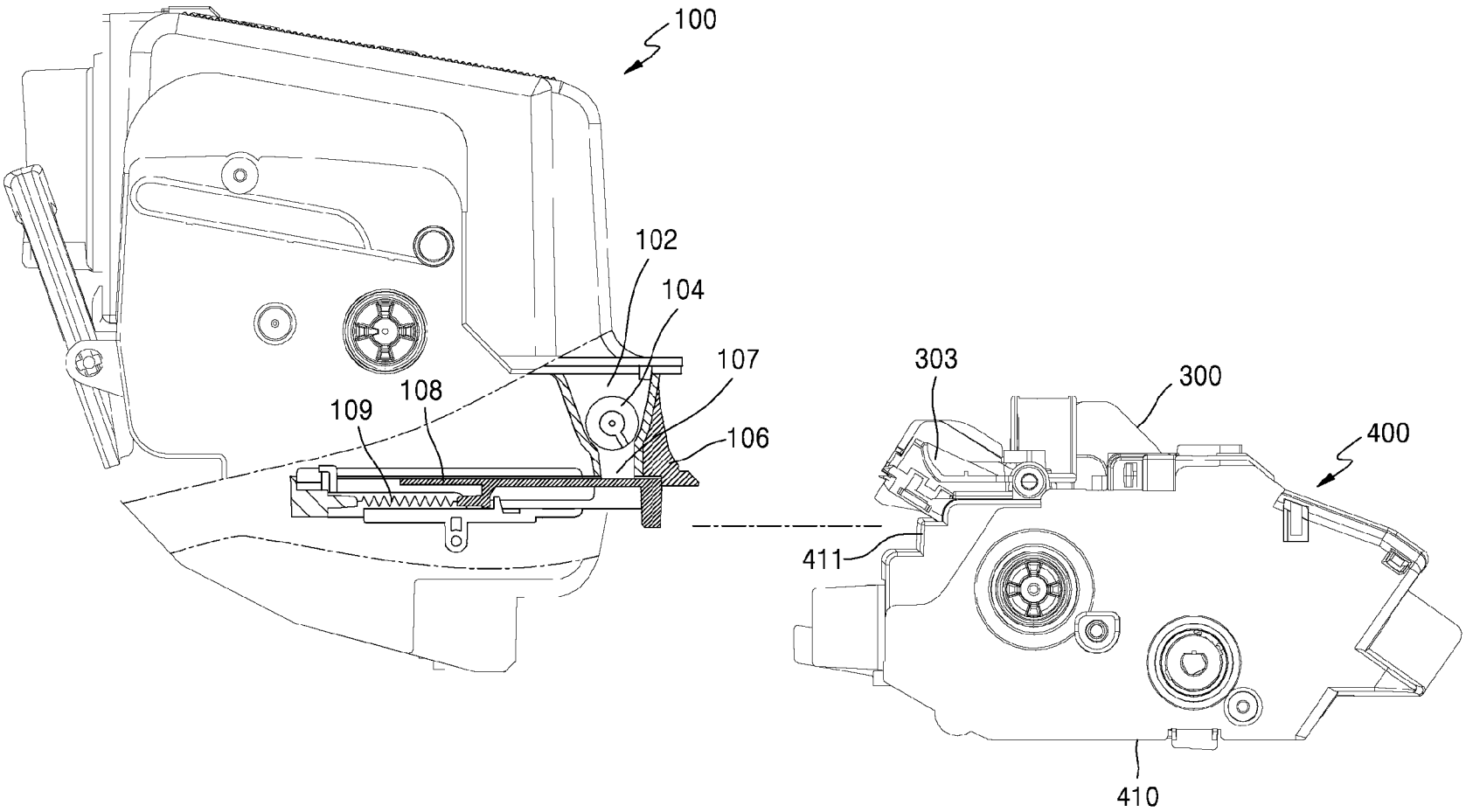
FIG. 11 is a partial cross-sectional view illustrating a toner discharging unit of the toner cartridge.
Figure 12:
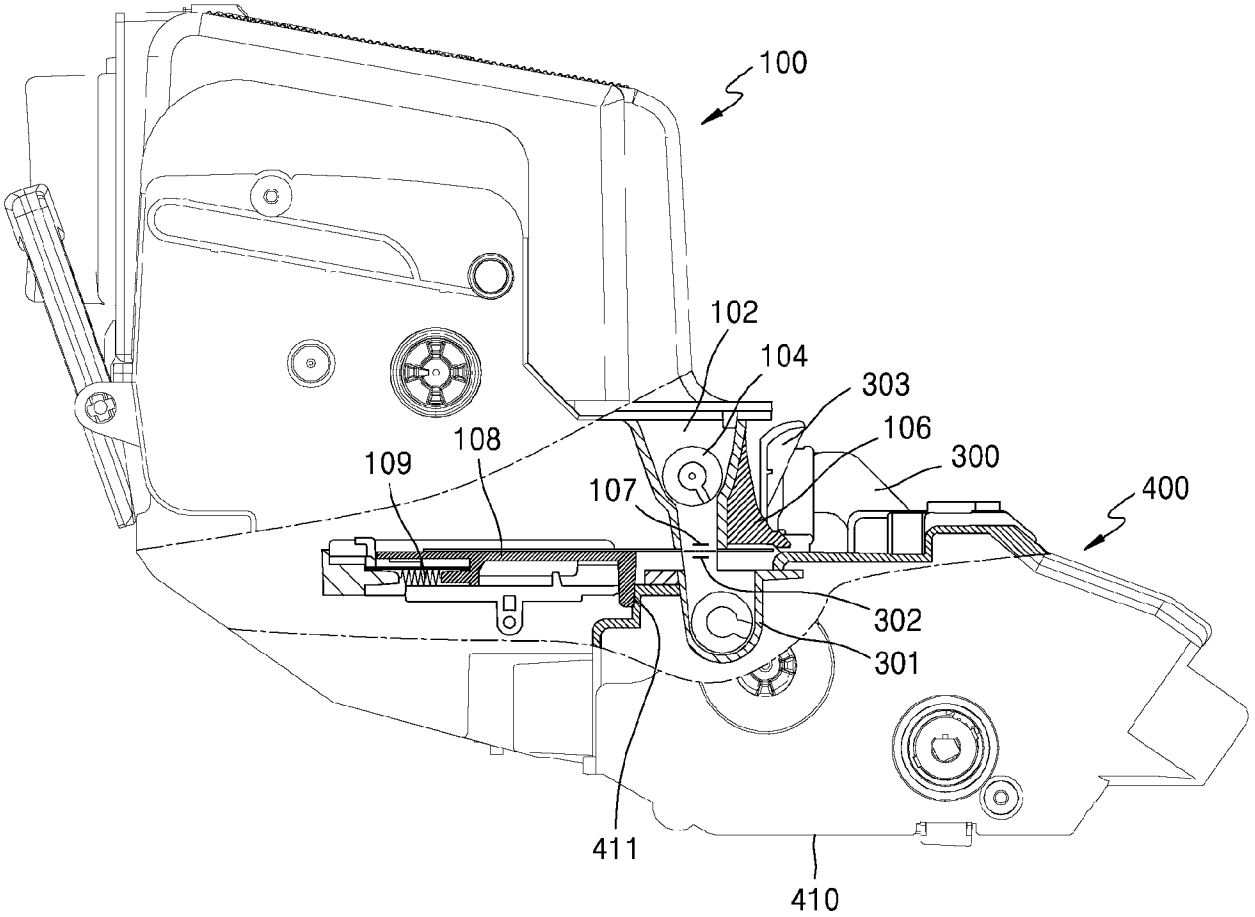
FIG. 12 is a partial cross-sectional view illustrating the toner cartridge mounted in a main body of the image forming apparatus.

FIG. 11 is a partial cross-sectional view illustrating the toner discharging unit 102 of the toner cartridge 100. FIG. 12 is a partial cross-sectional view illustrating the toner cartridge 100 mounted in the main body 100.

Referring to FIG. 11, a toner outlet 107 via which toner is supplied to the development unit 300 is provided in the toner discharging unit 102 of the toner cartridge 100. In order to prevent leakage of toner through the toner outlet 107 when handling the toner cartridge 100, a discharging shutter 108 that opens or closes the toner outlet 107 is provided in the toner cartridge 100. When the toner cartridge 100 is detached from the main body 1, the discharging shutter 108 is located at a position where the toner outlet 107 is blocked, as illustrated in FIG. 11. The shutter spring 109 applies to the discharging shutter 108 an elastic force in a direction in which the discharging shutter 108 closes the toner outlet 107.

In a state where the toner cartridge 100 is mounted in the main body 1, the discharging shutter 108 is located at a position where the toner outlet 108 is opened, as illustrated in FIG. 12. When the toner cartridge 100 is mounted in the main body 1, the discharging shutter 108 is moved to a position where the toner outlet 107 is opened due to interference with the lateral bracket 410, as illustrated in FIG. 12. Accordingly, the toner outlet 107 is aligned with the toner inlet 302 so that toner may be supplied from the toner cartridge 100 to the development unit 300.

The lateral bracket 410 has an interference portion 411 that interferes with the discharging shutter 108 when the toner cartridge 100 is mounted in the main body 1. When the discharging shutter 108 directly interferes with the development unit 300 in order to open or close the toner outlet 107, the development nip N or the development gap g may be affected by the elastic force of the shutter spring 109, and the elastic force of the elastic member 430 has to be increased in order to offset an influence of the elastic force of the shutter spring 109. However, according to an embodiment, the discharging shutter 108 is moved to a position where the toner outlet 107 is opened via interference with the interference portion 411 of the lateral bracket 410. The lateral bracket 410 is fixed to the photoconductive unit 200, and thus, even when the discharging shutter 108 interferes with the interference portion 411, an interference force affects only the photoconductive unit 200 and does not affect the development unit 300. Accordingly, according to the structure in which the discharging shutter 108 is opened or closed by interference between the discharging shutter 108 with the lateral bracket 410, the development nip N or the development gap g may be stably maintained.

It should be understood that the exemplary embodiments described therein should be considered in a descriptive sense only and not for purposes of limitation. The descriptions of features or aspects within each embodiment should be considered as being available for other similar features or aspects in other embodiments.

While one or more embodiments have been described with reference to the appended figures, it will be understood by those of ordinary skill in the art that various changes in form and details may be made therein without departing from the spirit and scope of the present disclosure as defined by the following claims.

What is claimed is:

1. An imaging cartridge detachable from a main body, the imaging cartridge comprising:

a photoconductive unit comprising a photoconductor on which an elastic latent image is formed;

a development unit comprising a development roller that supplies toner to the photoconductor to develop the toner and a gap maintaining member that constrains an approach distance between the development roller and the photoconductor;

a first position determining portion provided in the development unit;

a lateral bracket that is fixed to a side portion of the photoconductive unit and comprises a second position determining portion that guides the first position determining portion so as to movably support the development unit;

an elastic member that applies to the development unit an elastic force in a direction in which the development roller approaches the photoconductor; and a driving coupler that is provided at a side of the development unit and transfers a driving force of the main body to the development roller, wherein a rotational direction of the driving coupler is opposite to a rotational direction of the development roller, wherein the first position determining portion comprises a first position determining boss and a second position determining boss, wherein the second position determining portion comprises a first position determining slot and a second position determining slot that have a length such that the development unit is moved in the direction in which the development roller approaches the photoconductor or is separated from the photoconductor, wherein the first and second position determining bosses are disposed on the same side as the development roller with respect to an area where the development roller and the photoconductor face each other, and wherein the driving coupler is disposed between the first and second position determining bosses.

2. The imaging cartridge of claim 1, wherein the first and second position determining slots have a width such that the development unit is rotatable, and wherein rotation of the development unit is constrained as the first and second position determining bosses contact sidewalls of the first and second position determining slots in a width direction.

3. The imaging cartridge of claim 1, wherein a direction of a rotational moment applied to the development unit by the driving coupler is the same as a direction of a rotational moment applied to the development unit by the elastic member.

4. The imaging cartridge of claim 1, wherein the second position determining portion comprises a rotation constraining unit that constrains rotation of the development unit.

5. The imaging cartridge of claim 1, wherein the first position determining boss is located at a rotational center of the development roller.

6. The imaging cartridge of claim 5, wherein the development roller forms a development nip by contacting the photoconductor.

7. An image forming apparatus comprising:

a main body; and the imaging cartridge of claim 1.

8. The image forming apparatus of claim 7, further comprising a toner cartridge that is detachable from the main body and supplies toner to the imaging cartridge.

9. The image forming apparatus of claim 8, wherein the toner cartridge comprises a toner outlet through which the toner is discharged and a discharging shutter that opens or closes the toner outlet, wherein the discharging shutter is moved to a position where the toner outlet is opened by interacting with the imaging cartridge when the toner cartridge is mounted in the main body.

10. The image forming apparatus of claim 9, wherein the toner cartridge further comprises a shutter spring that elastically biases the discharging shutter such that the discharging shutter is moved to a position where the toner outlet is closed.

11. The image forming apparatus of claim 8, wherein the imaging cartridge comprises a toner inlet through which the toner enters and an inlet shutter that opens or closes the toner inlet.

12. The image forming apparatus of claim 11, wherein the imaging cartridge further comprises a spring that elastically biases the inlet shutter to a position where the toner inlet is closed.

13. The image forming apparatus of claim 12, wherein the inlet shutter is opened during the mounting of the toner cartridge to the main body.

14. The image forming apparatus of claim 13, wherein a protrusion is provided on the toner cartridge to open the inlet shutter.

15. The image forming apparatus of claim 7, wherein the first and second position determining slots have a width such that the development unit is rotatable, and wherein rotation of the development unit is constrained as the first and second position determining bosses contact sidewalls of the first and second position determining slots in a width direction.

16. The image forming apparatus of claim 7, wherein a direction of a rotational moment applied to the development unit by the driving coupler is the same as a direction of a rotational moment applied to the development unit by the elastic member.

17. The image forming apparatus of claim 7, wherein the second position determining unit comprises a rotation constraining unit that constrains rotation of the development unit.

18. The image forming apparatus of claim 7, wherein the first position determining boss is located at a rotational center of the development roller.

19. The image forming apparatus of claim 18, wherein the development roller forms a development nip by contacting the photoconductor.

20. An imaging cartridge detachable from a main body, the image cartridge comprising:

a photoconductive unit comprising a photoconductor on which an elastic latent image is formed;

a development unit comprising a development roller that supplies toner to the photoconductor to develop the toner and a gap maintaining member that constrains an approach distance between the development roller and the photoconductor;

a first position determining portion provided in the development unit;

a lateral bracket that is fixed to a side portion of the photoconductive unit and comprises a second position determining portion that guides the first position determining portion so as to movably support the development unit;

an elastic member that applies to the development unit an elastic force in a direction in which the development roller approaches the photoconductor;

a driving coupler that is provided at a side of the development unit and transfers a driving force of the main body to the development roller, a rotational direction of the driving coupler being opposite to a rotational direction of the development roller; and a driving side portion where the driving coupler is disposed and a non-driving side portion on the opposite side of the driving side portion, wherein the elastic member comprises a first elastic member and a second elastic member that are respectively disposed on the driving side portion and the non-driving side portion, and wherein an elastic force of the first elastic member is smaller than an elastic force of the second elastic member.

21. An image forming apparatus comprising:

a main body; and an imaging cartridge detachable from the main body, the imaging cartridge comprising:

a photoconductive unit comprising a photoconductor on which an elastic latent image is formed, a development unit comprising a development roller that supplies toner to the photoconductor to develop the toner and a gap maintaining member that constrains an approach distance between the development roller and the photoconductor, a first position determining portion provided in the development unit, a lateral bracket that is fixed to a side portion of the photoconductive unit and comprises a second position determining portion that guides the first position determining portion so as to movably support the development unit, an elastic member that applies to the development unit an elastic force in a direction in which the development roller approaches the photoconductor, and a toner cartridge that is detachable from the main body and supplies toner to the imaging cartridge, wherein the toner cartridge comprises a toner outlet through which the toner is discharged and a discharging shutter that opens or closes the toner outlet, wherein the discharging shutter is moved to a position where the toner outlet is opened by interacting with the imaging cartridge when the toner cartridge is mounted in the main body, wherein the lateral bracket includes an interference portion that contacts the discharging shutter to move the discharging shutter to a position where the toner outlet is opened when the toner cartridge is mounted in the main body.

22. An image forming apparatus comprising:

a main body; and an imaging cartridge detachable from the main body, the imaging cartridge comprising:

a photoconductive unit comprising a photoconductor on which an elastic latent image is formed, a development unit comprising a development roller that supplies toner to the photoconductor to develop the toner and a gap maintaining member that constrains an approach distance between the development roller and the photoconductor, a first position determining portion provided in the development unit, a lateral bracket that is fixed to a side portion of the photoconductive unit and comprises a second position determining portion that guides the first position determining portion so as to movably support the development unit, an elastic member that applies to the development unit an elastic force in a direction in which the development roller approaches the photoconductor, a driving coupler that is provided at a side of the development unit and transfers a driving force of the main body to the development roller, a rotational direction of the driving coupler being opposite to a rotational direction of the development roller, and a driving side portion where the driving coupler is disposed and a non-driving side portion on a side opposite the driving side portion, wherein the first position determining portion comprises a first position determining boss and a second position determining boss, wherein the second position determining portion comprises a first position determining slot and a second position determining slot that have a length such that the development unit is moved in the direction in which the development roller approaches the photoconductor or in a direction in which the development roller is separated from the photoconductor, wherein the first position determining boss is located at a rotational center of the development roller, wherein the elastic member comprises a first elastic member and a second elastic member that are respectively disposed on the driving side portion and the non-driving side portion, and wherein an elastic force of the first elastic member is smaller than an elastic force of the second elastic member.

* * * * *